United States Patent [19]

Emery

[11] 4,436,165

[45] Mar. 13, 1984

[54] DRAIN HOLE DRILLING

[75] Inventor: Leonard W. Emery, Plano, Tex.

[73] Assignee: Atlantic Richfield Company, Los Angeles, Calif.

[21] Appl. No.: 414,212

[22] Filed: Sep. 2, 1982

[51] Int. Cl.[3] ..... E21B 71/00

[52] U.S. Cl. ..... 175/61; 166/285; 166/50

[58] Field of Search ..... 175/61; 166/50, 285, 166/286, 287, 288, 289, 290, 291, 292, 293, 294, 295

[56] References Cited

U.S. PATENT DOCUMENTS 2,079,517 5/1937 McQuiston ..... 166/293
2,193,807 3/1940 Dieterich ..... 166/292

FOREIGN PATENT DOCUMENTS 142241 5/1970 U.S.S.R. ..... 166/286

OTHER PUBLICATIONS

Ranney, Leo, *The Petroleum Engineer*, Jun. 1939, The First Horizontal Oil Well, pp. 25–30.

*Primary Examiner*—Ernest R. Purser
*Assistant Examiner*—Timothy David Hovis
*Attorney, Agent, or Firm*—Roderick W. MacDonald

[57] ABSTRACT

A method for enhancing the recovery of liquid products from a wellbore having at least one laterally extending drain hole wellbore extending therefrom, wherein a portion of the primary wellbore near the drain hole wellbore and a portion of the drain hole wellbore itself are completely filled with a hardenable material and the hardened material is then re-drilled leaving an outer layer of hardened material to line the primary wellbore and part of the drain hole wellbore so that gas cannot prematurely cone into the primary wellbore, thereby enhancing liquid recovery by way of the unlined portion of the drain hole wellbore before any gas reaches the drain hole wellbore.

6 Claims, 4 Drawing Figures

DRAIN HOLE DRILLING

BACKGROUND OF THE INVENTION

Heretofore, various types of deviated wellbores have been drilled from a primary wellbore. One particular type of deviated wellbore, known as a drain hole, is drilled from a primary wellbore through a sharp radius of curvature so as to extend laterally away from the primary wellbore. Normally, although not necessarily, the primary wellbore is essentially vertical and the drain hole, after passing through its sharp radius of curvature extends essentially horizontally away from the primary wellbore out into the producing geologic formation. Drain holes, and the method for drilling same, are fully and completely disclosed in U.S. Pat. Nos. 3,349,845 and 3,398,804.

BRIEF SUMMARY OF THE INVENTION

Often the drain hole is deliberately drilled into a liquid, e.g. crude oil, producing formation or strata to maximize the recovery of liquid therefrom. Such a formation or strata sometimes has adjacent thereto a gas, e.g. natural gas, producing formation or strata overlying or otherwise adjacent the liquid producing formation. In those cases, the potential is present for producing both gas and liquid from the drain hole into the primary wellbore for recovery of both gas and liquid at the surface of the earth.

It has been found that in some such situations, the gas may preferentially sweep into the drain hole, particularly in the area of the radius of curvature of the drain hole, thereby reducing the amount of liquid produced from the drain-hole. According to this invention, a method for drilling drain hole wellbores is provided which enhances liquid production from the drain hole by drilling at least a first portion, but not necessarily all of, the drain hole wellbore. Thereafter, a portion of the primary wellbore and only the first portion of the drain hole wellbore are completely filled with a hardenable material which is then allowed to harden. The hardened material is then re-drilled to leave a primary wellbore and first portion of the drain hole wellbore lined with the hardened material, and an unlined extension of the drain hole wellbore passing outwardly into the liquid producing formation.

Accordingly, it is an object of this invention to provide a new and improved method for increasing the productivity of new or old primary wellbores. It is another object to provide a new and improved method for drilling for and producing hydrocarbonaceous fluids from the earth. It is another object to provide a new and improved method for enhancing the recovery of fluids by way of a drain hole wellbore when gas is closely associated with a liquid.

Other aspects, objects and advantages of this invention will be apparent to those skilled in the art from this disclosure and the appended claims.

DETAILED DESCRIPTION OF THE INVENTION

Figure 1:
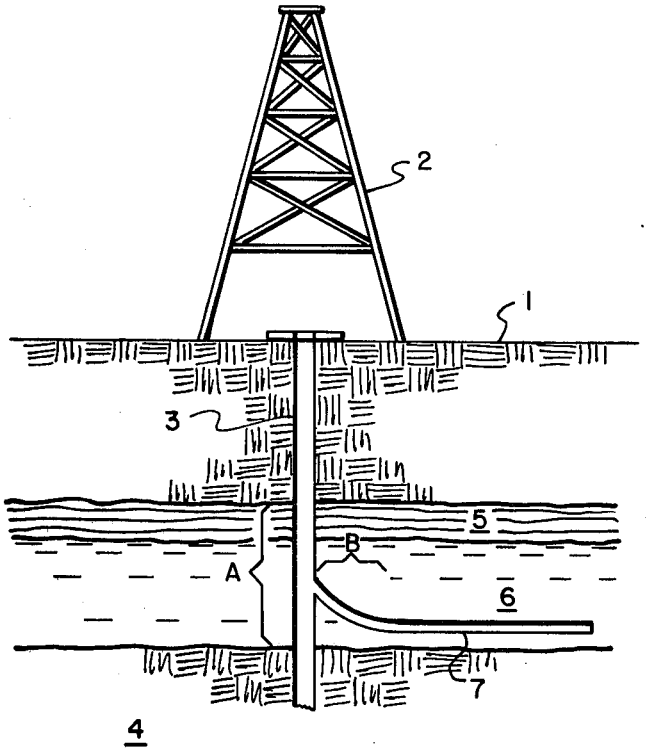
FIG. 1 shows a cross-section of a primary wellbore and drain hole wellbore in the earth.

FIG. 1 shows the surface of the earth 1 with drilling rig 2 set over a primary wellbore 3 which extends essentially vertically downwardly into the earth 4. In area A of primary wellbore 3 are two fluid producing geologic formations, for example, an upper formation 5 which produces natural gas, and a lower formation 6 which produces liquid crude oil. A drain hole wellbore 7 has been drilled laterally from wellbore 3 and, after passing through a radius of curvature portion B, extends essentially horizontally away from wellbore 3 out into oil producing formation 6. Wellbore 7 thereby enhances the flow of oil from formation 6 into drain hole 7 for production to the earth's surface 1 in a conventional manner by way of primary wellbore 3.

Wellbores 3 and 7 can be either cased or uncased, cemented or uncemented, as far as the application of this invention goes. Wellbore 3 can be a newly drilled well or an old well that is being worked over for drain hole purposes. The invention will be described hereinafter, only for sake of simplicity, as though both the wellbores were newly drilled and not cased or cemented. However, it should be understood that this invention also applies to cased and/or cemented wellbores, work overs, and the like.

Figure 2:
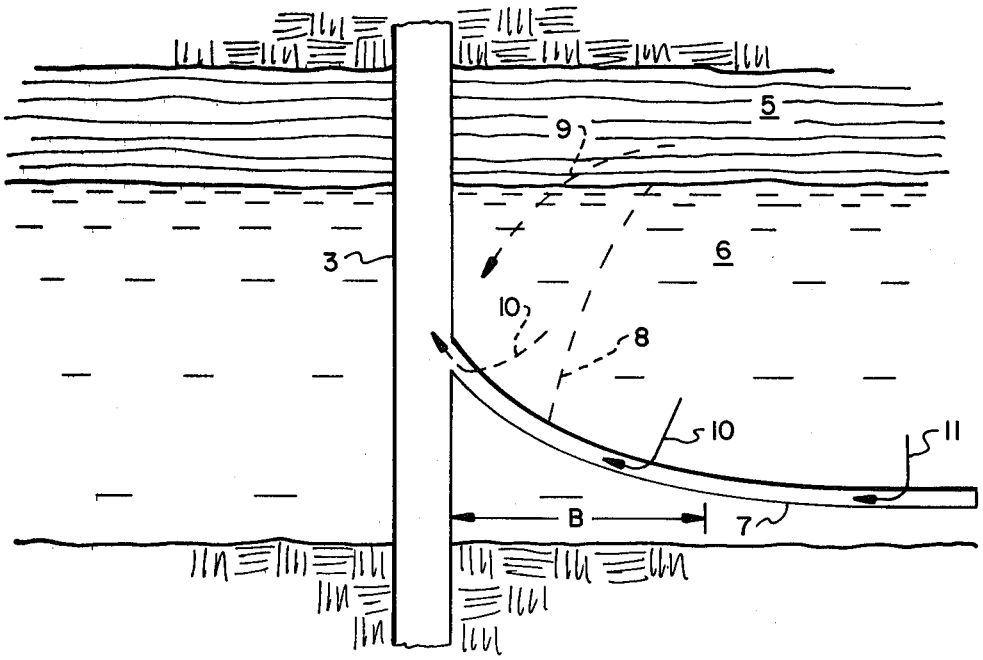
FIG. 2 shows an enlarged cross-section of the primary and drain hole wellbores of FIG. 1 when gas and oil are produced without the practice of this invention.

FIG. 2 shows the situation of oil and gas production into primary wellbore 3 after production has been carried out for a while. What sometimes occurs in such a situation is that gas, because of its greater mobility in the earth, will cone downwardly toward drain hole 7 as indicated by dotted line 8 and arrows 9 and 10, so that gas enters primary wellbore 3 ahead of liquid oil, as represented by arrows 10 and 11. Gas coning into the drain hole prematurely decreases the amount of liquid produced by way of the drain hole. This is disadvantageous because, ideally, all liquid is produced from reservoir 6 first taking advantage of the pressure drive from the gas in reservoir 5 to help drive the oil out of reservoir 6. However, if gas prematurely escapes to primary wellbore 3 by coning, the gas cap can be depleted and its assistance in removing oil from reservoir 6 reduced before the optimum amount of oil has been recovered from reservoir 6 by way of drain hole 7.

Figure 3:
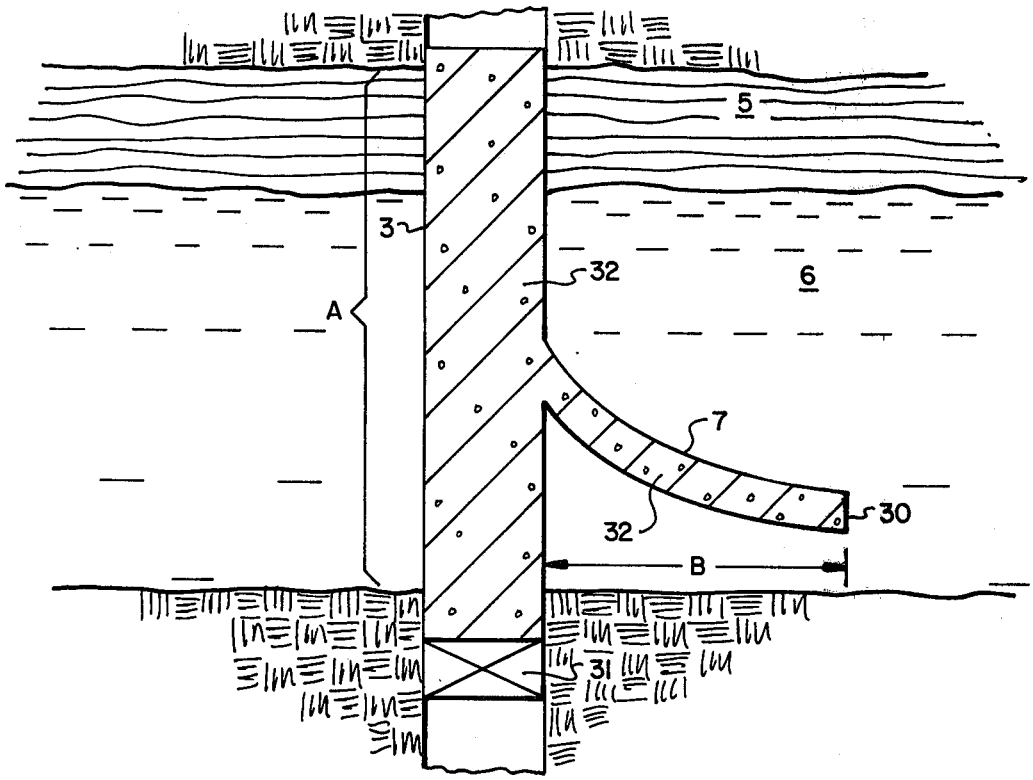
FIGS. 3 and 4 show an enlarged cross-section of the same primary and drain hole wellbores and the production of gas and oil therefrom in accordance with this invention.

FIG. 3 shows primary wellbore 3 after the radius of curvature portion B of drain hole wellbore 7 is drilled and terminated at point 30. Point 30 is the approximate location at which drain hole wellbore 7 reaches essentially a horizontal attitude and starts to head directly away from wellbore 3. After the radius of curvature portion B is drilled, primary wellbore 3 has set therein a conventional bridge plug or other packoff means 31 which plugs wellbore 3 so that a fluid material can be pumped into wellbore 3 and come to rest on and be supported by packoff 31. Thereafter, wellbore 3, at least in area A and all of the radius of curvature portion B of drain hole wellbore 7, is filled with a hardenable material which is then left to harden. The hardened material 32 completely fills primary wellbore 3 in area A and the drilled portion of drain hole wellbore 7.

Figure 4:
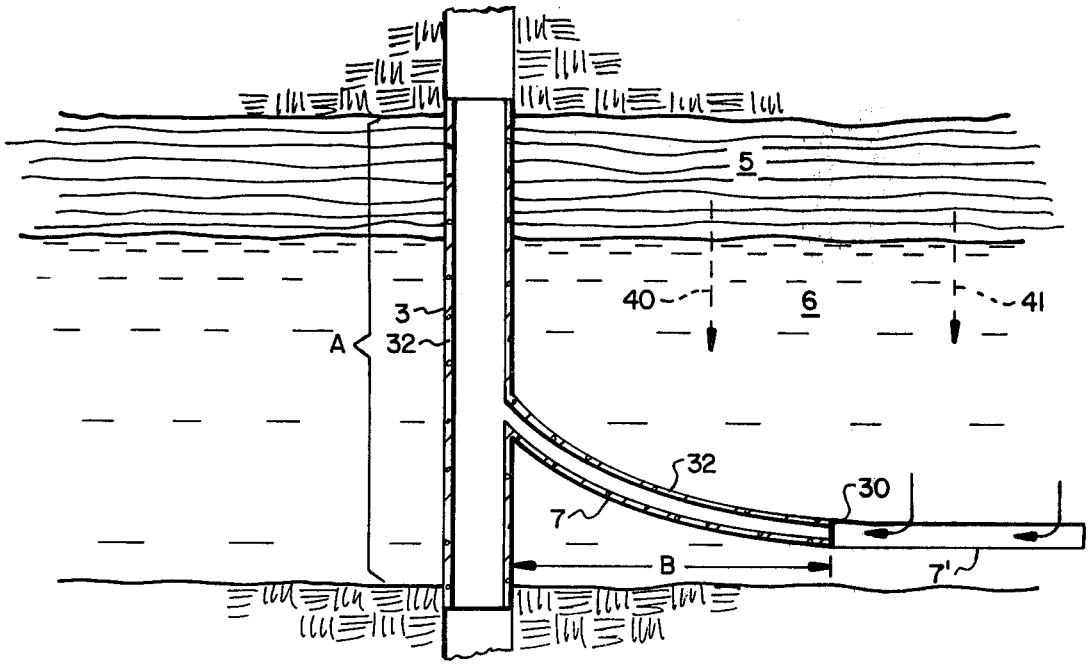

Thereafter, as shown in FIG. 4, hardened material 32 is re-drilled, including bridge plug 31, to re-establish primary wellbore 3. Radius of curvature portion B of drain hole wellbore 7 is also re-drilled and wellbore 7 further extended to the desired distance away from wellbore 3 as represented by 7'. Thus, drain hole wellbore 7 ultimately ends up as a continuous but two segment wellbore. The first segment is adjacent primary wellbore 3 and is lined with hardened material 32. The second segment is unlined so that fluids from formations 5 and 6 can enter drain hole wellbore 7 and pass therethrough into primary wellbore 3 for production to the earth's surface. By leaving an outer layer of hardened material 32 in primary wellbore 3 in area A and in the radius of curvature portion B of drain hole wellbore 7, these portions of both wellbores are rendered essentially gas impermeable so that gas coning, such as that shown for FIG. 2 above, can no longer occur. Thereafter, gas passing downwardly from formation 5 into formation 6, as shown by arrows 40 and 41, must pass essentially completely through formation 6 to reach unlined drain hole wellbore portion 7'. In so doing, the gas must push essentially all of the oil present in formation 6 ahead of it into drain hole wellbore 7 before any gas reaches that drain hole wellbore. This substantially enhances the production of liquid oil from formation 6 before any gas from formation 5 reaches the drain hole wellbore.

Generally, any material which will become rigid under down hole wellbore conditions can be employed for hardenable material 32. The most useful material which is readily available in the oil patch is cement or cementitious materials which are normally used to fill in spaces between steel wellbore casing and the earth surrounding that casing. Thus, any cementing material normally used in current wellbore applications can be used as hardenable material 32. Cementitious compositions and techniques for displacing and hardening same are already well known in the art. Of course, other hardenable materials such as polymeric materials and the like can be employed, but by far the most available and well known material will be cement based.

Although it has been described hereinabove that essentially the full radius of curvature B is drilled and filled with hardenable material, it is within this invention to drill and fill more or less than the full radius of curvature B. For example, wellbore 7 can be drilled for a distance greater than radius of curvature B so that a portion of the essentially horizontal section 7' of FIG. 4 beyond end 30 will have an outer hardened layer 32. Similarly, less than the full length of radius of curvature B can be lined with hardened material 32. It is only required by this invention that a sufficient portion of the drain hole wellbore be lined with hardened material to reduce gas coning. It is not critical whether that portion is the same as, less than, or greater than radius of curvature portion B so long as a portion of the drain hole wellbore is lined and gas coning is substantially reduced or eliminated. It will depend upon the particular circumstances of the specific well in question as to how much of drain hole wellbore 7 needs to be lined in order to accomplish the goals of this invention.

Other obvious approaches can be taken to achieve the results of this invention and these approaches are also within the scope of this invention. For example, instead of stopping drain hole wellbore 7 drilling at point 30 of FIG. 3, the entire wellbore 7 could be drilled as shown in FIG. 4 before any hardenable material is introduced into the primary or drain hole wellbores. Thereafter, a conventional packoff, such as bridge plug 31 of FIG. 3, could be employed at point 30 in drain hole wellbore 7 or any other desired point in wellbore 7 to plug that wellbore. Wellbore 3 would also be plugged with bridge plug 31 as shown in FIG. 3. After plugging both wellbores 3 and 7, hardenable material can be pumped into wellbores 3 and 7 upstream of bridge plugs 31 and allowed to harden. The hardened material is then re-drilled, including drilling through the bridge plugs 31 in both wellbores, to achieve a lined wellbore 3 and partially lined wellbore 7, essentially as shown in FIG. 4. Other obvious approaches to achieve the same result can be devised by those skilled in the art once advised of this invention and the advantages therefor, and such approaches are also within the scope of this invention.

Reasonable variations and modifications are possible within the scope of this disclosure without departing from the spirit and scope of this invention.

I claim:

1. In a method for drilling at least one laterally extending drain hole wellbore from a primary wellbore into an area of the earth that produces both gas and liquid, the improvement comprising drilling a first portion of said drain hole wellbore into said area, said first portion being at least through the radius of curvature portion of said drain hole wellbore, filling said primary wellbore in said area and at least said radius of curvature portion of said drain hole wellbore with a hardenable material, allowing said material to harden, and re-drilling said primary wellbore and said filled portion of said drain hole wellbore to leave an outer layer of said hardened material around said primary and drain hole wellbores whereby in said area of gas and liquid production a lined primary wellbore and a lined first portion of said drain hole wellbore adjacent said primary wellbore is established to thereby reduce gas coning into same and enhance liquid production through the unlined portion of said drain hole wellbore.

2. In the method according to claim 1 wherein said hardenable material is cement based.

3. In the method according to claim 1 wherein said gas is essentially natural gas and said liquid is essentially crude oil.

4. In the method according to claim 1 wherein said area of the earth that produces both gas and liquid is composed of a liquid producing formation and at least one adjacent gas producing formation, and said at least one drain hole wellbore is drilled into said liquid producing formation.

5. In the method according to claim 4 wherein at least one drain hole wellbore is drilled as far from said gas producing formation as possible while staying within said liquid producing formation.

6. In the method according to claim 1 wherein the full length of said at least one drain hole wellbore is drilled, said drain hole wellbore is plugged at or downstream of the end of said radius of curvature portion, only the part of said drain hole wellbore upstream of said plug is filled with hardenable material and then re-drilled to re-establish communication through the entire length of the lined and unlined portions of said drain hole wellbore.

* * * * *